United States Patent [19]

McKay

[11] Patent Number: 4,955,753

[45] Date of Patent: Sep. 11, 1990

[54] ROADWAY BARRIER SYSTEM

[76] Inventor: Alan R. McKay, 1126 Hilltop Dr., Lafayette, Calif. 94549

[21] Appl. No.: 438,763

[22] Filed: Nov. 17, 1989

Related U.S. Application Data

[63] Continuation-in-part of Ser. No. 220,926, Jul. 18, 1988, Pat. No. 4,881,845, which is a continuation of Ser. No. 815,456, Jan. 2, 1986, abandoned.

[51] Int. Cl.[5] ..... E01F 13/00

[52] U.S. Cl. ..... 404/6; 256/13.1

[58] Field of Search ..... 404/6, 9, 13; 256/1, 256/13.1

[56] References Cited

U.S. PATENT DOCUMENTS

| | | | |
|---|---|---|---|
| 3,958,890 | 5/1976 | Ferrari | 404/9 |
| 4,017,200 | 4/1977 | Woods, Jr. | 404/9 |
| 4,185,265 | 1/1980 | Griffin et al. | 404/9 |
| 4,406,563 | 9/1983 | Urlberger | 404/6 |
| 4,474,503 | 10/1984 | Booth et al. | 404/6 |
| 4,498,803 | 2/1985 | Quittner | 404/13 |
| 4,500,225 | 2/1985 | Quittner | 404/6 |
| 4,629,357 | 12/1986 | Wattenburg et al. | 404/6 |
| 4,653,954 | 3/1987 | Booth et al. | 404/6 |
| 4,881,845 | 11/1989 | McKay | 404/6 |

*Primary Examiner*—Stephen J. Novosad
*Assistant Examiner*—Gay Ann Spahn
*Attorney, Agent, or Firm*—Flehr, Hohbach, Test, Albritton & Herbert

[57] ABSTRACT

Roadway barrier system which provides a safe separation between opposing lanes of vehicular traffic and is capable of being moved across a lane to change the direction of traffic flow in the lane. A plurality of barrier sections are positioned end-to-end along one side of the lane, and a vehicle which travels along the lane has a transfer beam in the form of a figure-8 with a portion of the beam extending diagonally across the lane for transferring the barrier sections from one side of the lane to the other as the vehicle travels along the lane. Hinged connections between the barrier sections permit the sections to be positioned different distances apart and at different angles relative to each other, and striations on the side faces of the barrier sections help to prevent vehicles which contact the barrier sections from climbing over the barrier.

16 Claims, 15 Drawing Sheets

ROADWAY BARRIER SYSTEM

This is a continuation-in-part of Ser. No. 07/220,926, filed Jul. 18, 1988, now U.S. Pat. No. 4,881,845, which was a continuation of Ser. No. 06/815,456, filed Jan. 2, 1986, now abandoned.

This invention pertains generally to barriers such as are used on highways to separate traffic lanes and, more particularly, to a system in which the barrier sections can be shifted laterally across the lanes to increase or decrease the number of lanes in a given direction of travel.

U.S. Pats. No. 4,474,503 and 4,500,225 disclose systems in which sections of a roadway barrier may be shifted laterally from one lane to another. The equipment and methods described in these patents are relatively complicated in that they employ a large number of wheels or rollers which engage the extended top flanges of the barrier sections to lift the sections and transfer them from one side of a lane to the other. With rollers on both sides of the sections, the sections are, in effect, forced to pass through a narrow, winding channel or pathway. This limits the length and, hence, the weight of the sections and may result in insufficient mass in any one section to resist the impact forces of a crashing vehicle, in which case complicated locking or torsional devices may be required to promote interaction between adjacent sections.

Another problem with the movable barrier systems heretofore provided is that the transfer vehicles may be of such dimensions as to protrude beyond the barrier into the active traffic lanes, creating a hazard.

It is in general an object of the invention to provide a new and improved roadway barrier system which overcomes the limitations and disadvantages of the systems heretofore provided.

Another object of the invention is to provide a barrier system of the above character which is relatively simple and reliable.

These and other objects are achieved in accordance with the invention by providing a plurality of elongated barrier sections positioned end-to-end along one side of the lane, a vehicle which travels along the lane having a transfer beam in the form of a figure-8 with a portion of the beam extending diagonally across the lane, a pair of pick-up elements affixed to each of the barrier sections, and a plurality of trolleys mounted on the transfer beam for movement around the loop and into lifting engagement with the pick-up elements on successive ones of the barrier sections for carrying the barrier sections across the diagonally extending portion of the beam from one side of the lane to the other as the vehicle travels along the lane. Hinged connections between the barrier sections permit the sections to be positioned different distances apart and at different angles relative to each other, and striations on the side faces of the barrier sections help to prevent vehicles which contact the barrier sections from climbing over the barrier.

Figure 5:
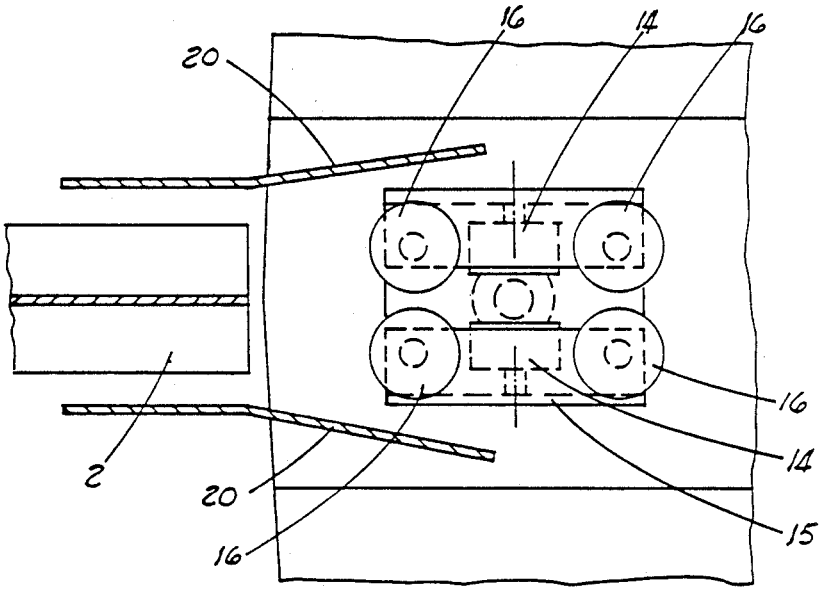

FIG. 5 is a sectional plan cut immediately above the top surface of the horizontal guide roller of an embodiment of the invention, just prior to the engagement of the pick-up beam. In this figure, the vehicle is moving to the right. For clarity, the adjacent barrier unit, and the locking plate are not shown.

Figure 6:
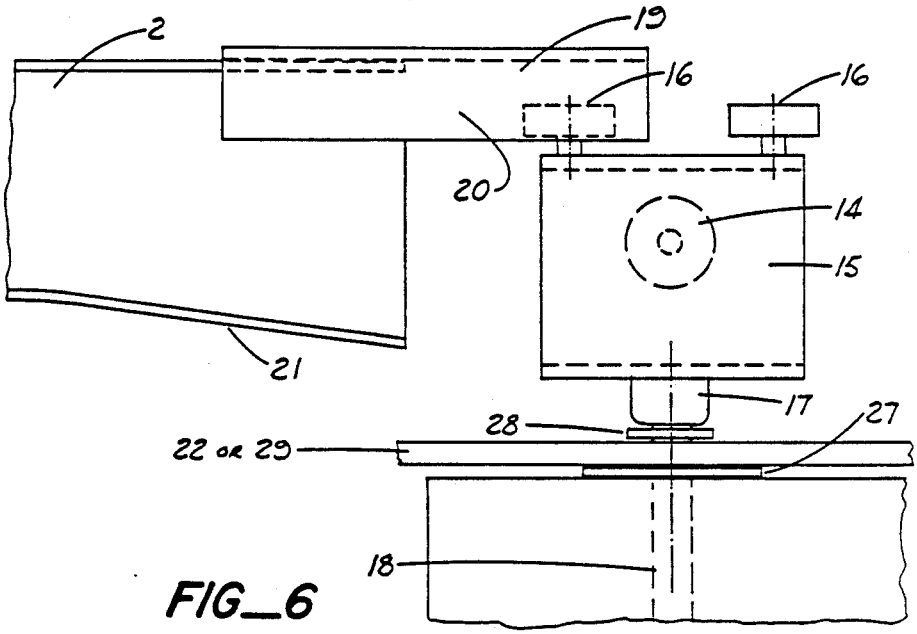

FIG. 6 is an elevation of an embodiment of the invention showing the condition just prior to engagement of the pick-up beam. In this figure, the vehicle is moving to the right. For clarity, the adjacent barrier unit is not shown.

Figure 7:
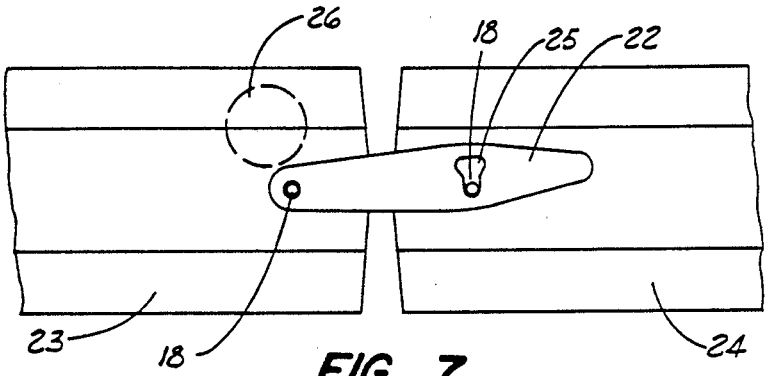

FIG. 7 is a plan showing an embodiment of the spacing and locking system, shown in the locked position.

Figure 8:
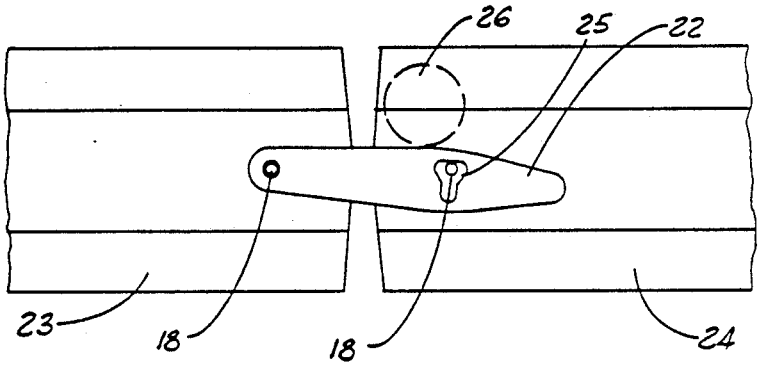

FIG. 8 is a plan of an embodiment of a spacing and locking system, shown in the unlocked position.

Figure 9:
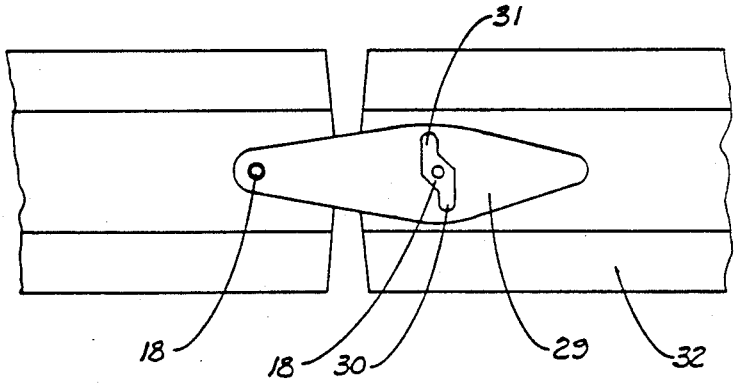

FIG. 9 is a plan showing an embodiment of a locking system which allows the units to be spaced and locked at either one of two different pre-determined spacings.

Figure 10:
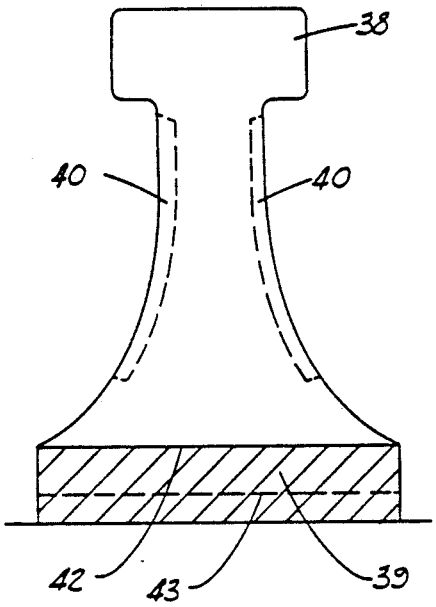

FIG. 10 is a vertical section showing the preferred profile of the barrier.

Figure 11:
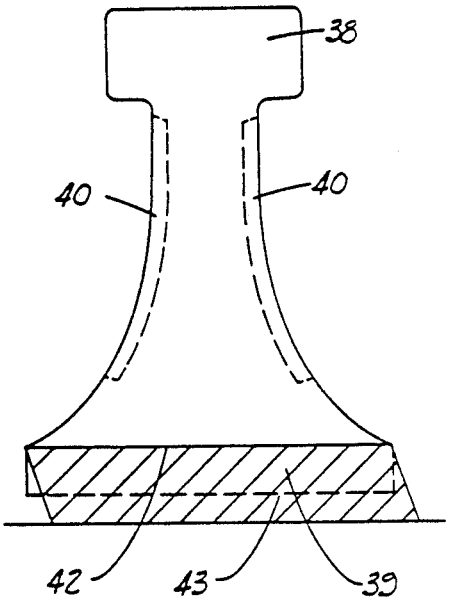

FIG. 11 is a vertical section through the barrier showing the shear deflection of the support pad during impact.

Figure 12:
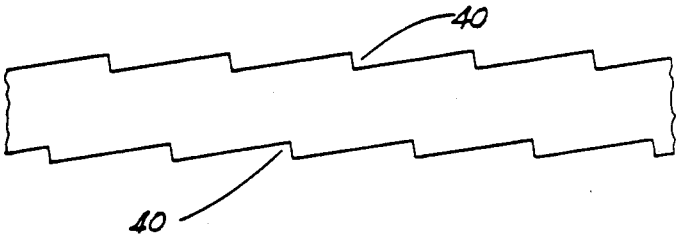

FIG. 12 is a horizontal section through the web of the barrier showing the preferred profile of the indented striations.

Figure 13:
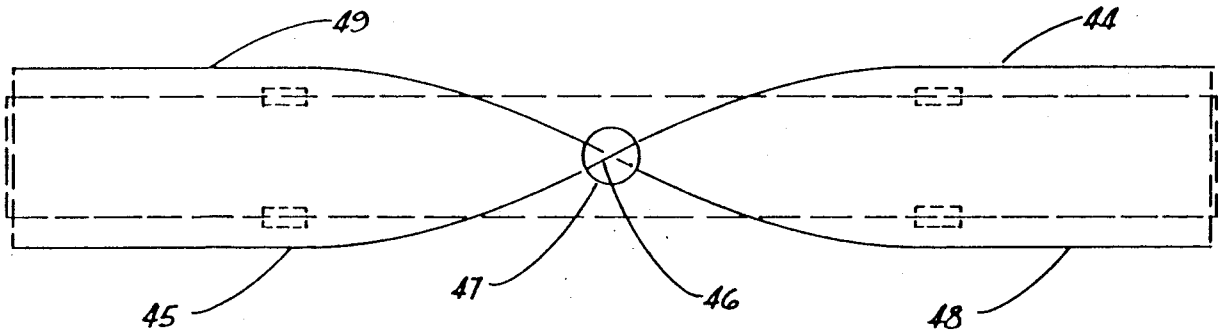

FIG. 13 is a diagrammatic plan which shows an embodiment which allows transfer of lanes either from left to right or from right to left, with the ability to quickly change the direction of transfer.

Figure 14:
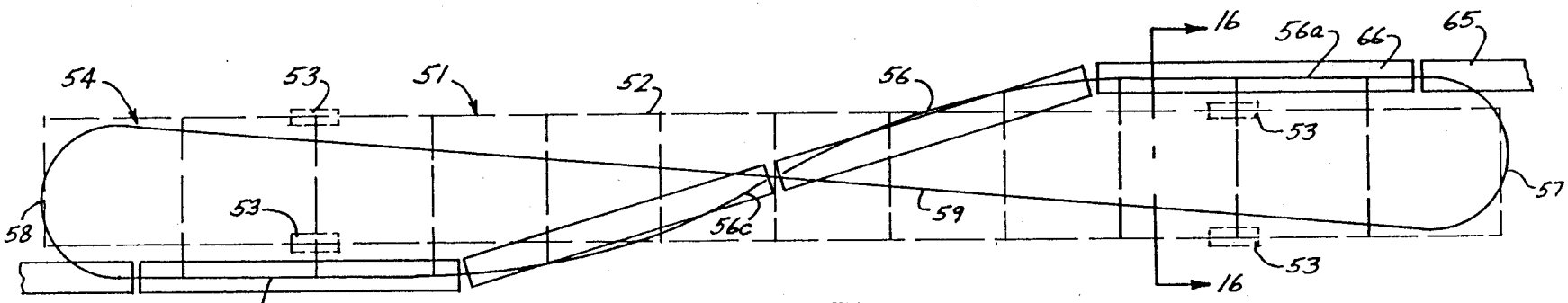

FIG. 14 is a diagrammatic plan view of a second embodiment of a roadway barrier system according to the invention.

Figure 15:
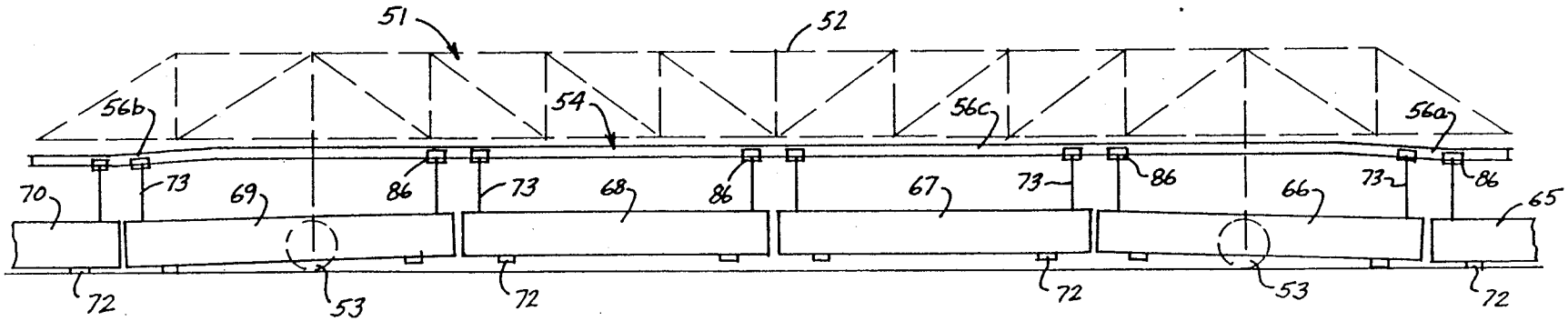

FIG. 15 is a diagrammatic elevational view of the embodiment of FIG. 14.

Figure 16:
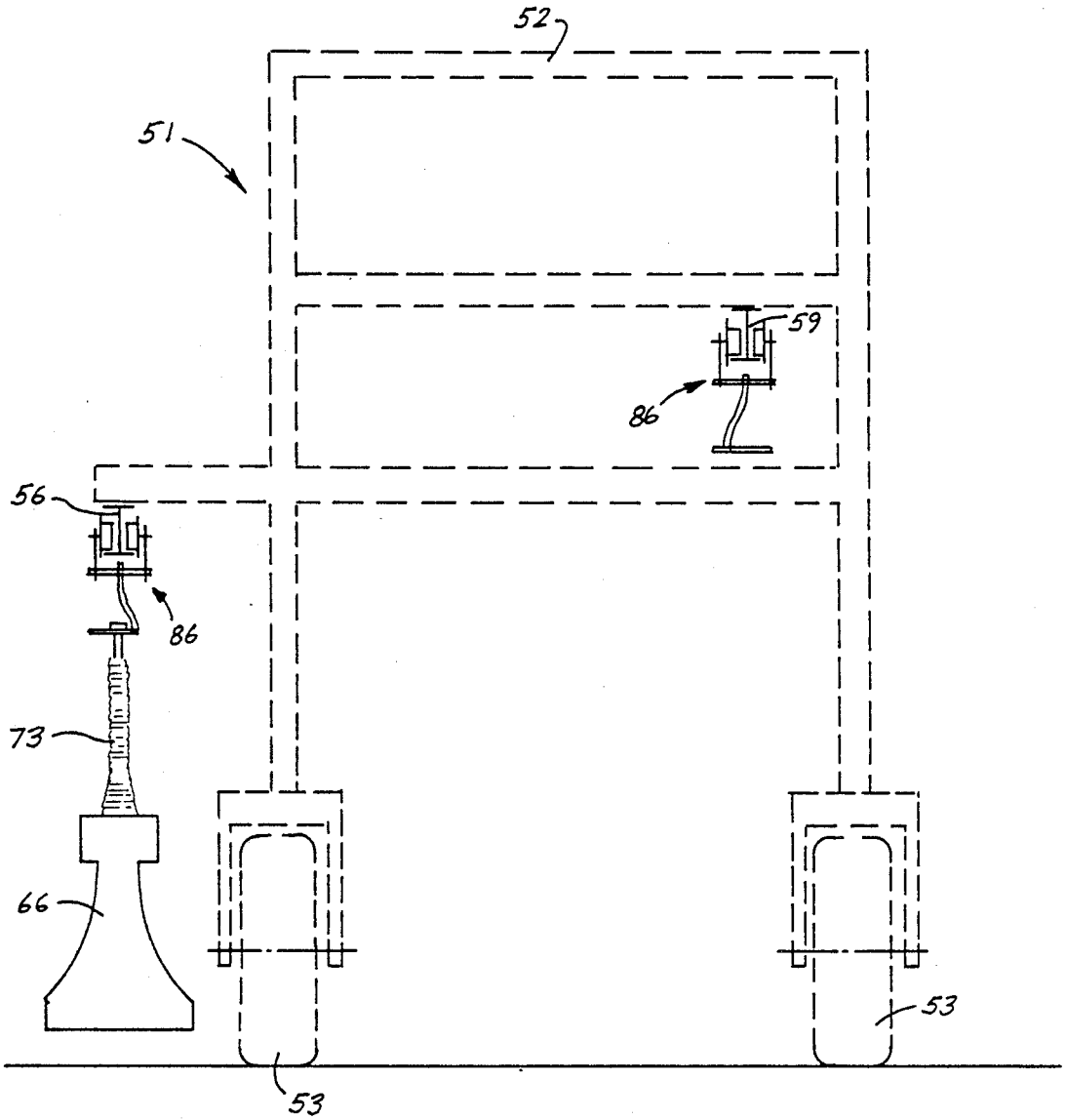

FIG. 16 is a diagrammatic cross-sectional view taken along line 16—16 in FIG. 14.

Figure 17:
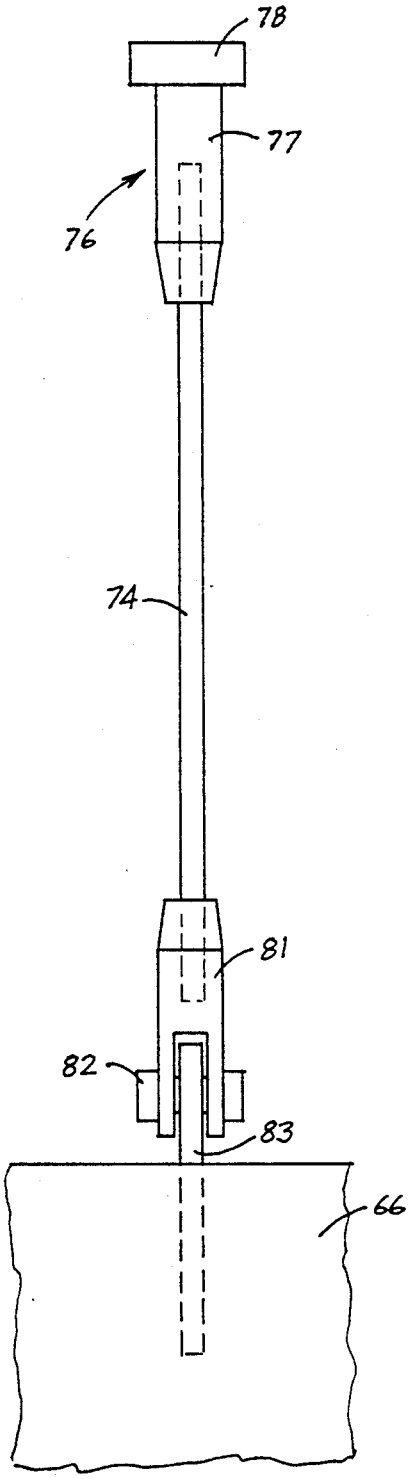
Figure 18:
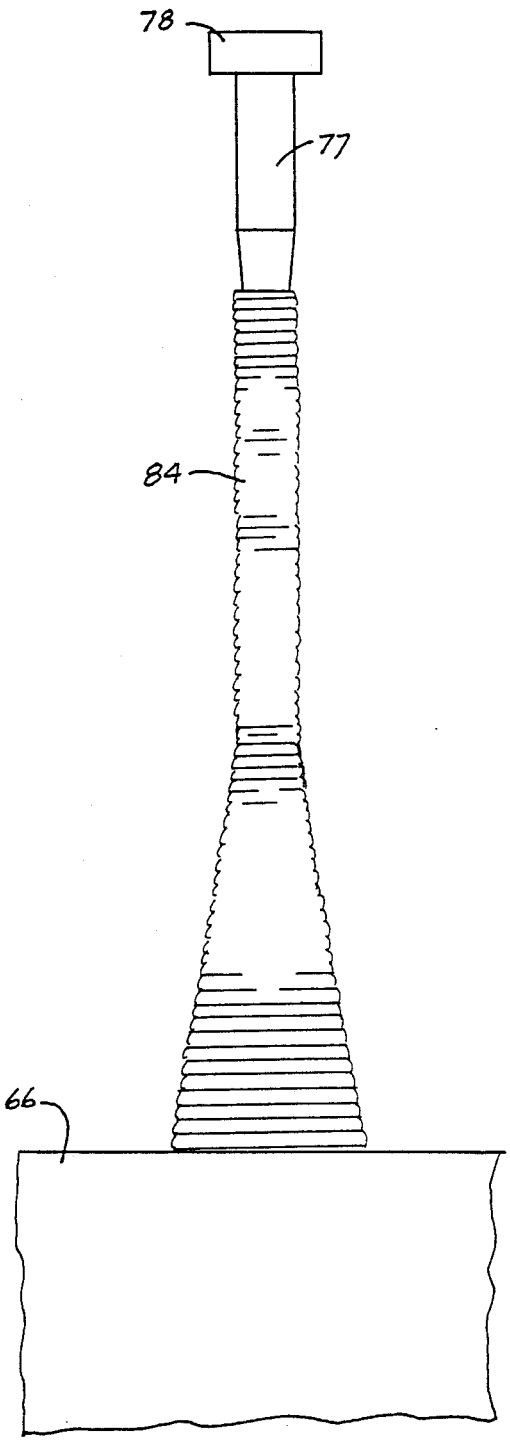

FIGS. 17 and 18 are elevational views of a pick-up element affixed to the barrier sections in the embodiment of FIG. 14.

Figure 19:
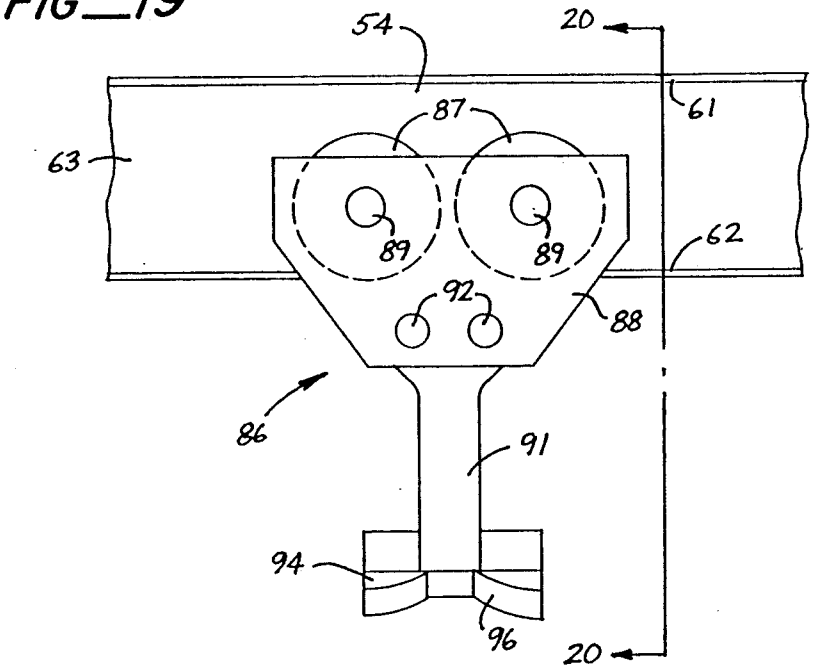

FIG. 19 is an elevational view of a trolley on the transfer beam in the embodiment in FIG. 14.

Figure 20:
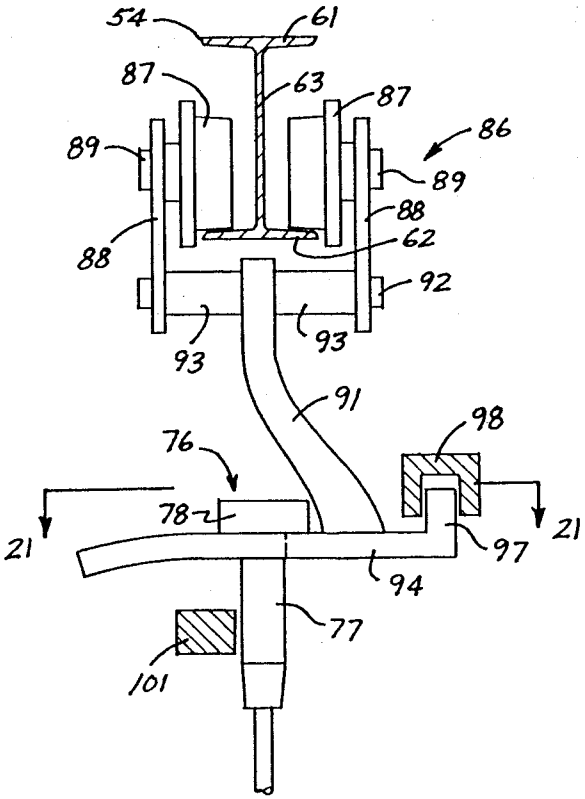

FIG. 20 is a cross-sectional view taken along line 20—20 in FIG. 19.

Figure 21:
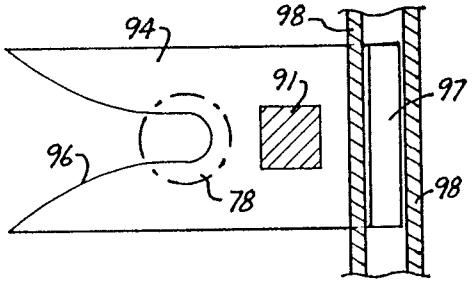

FIG. 21 is a cross-sectional view taken along line 21—21 in FIG. 20.

Figure 22:
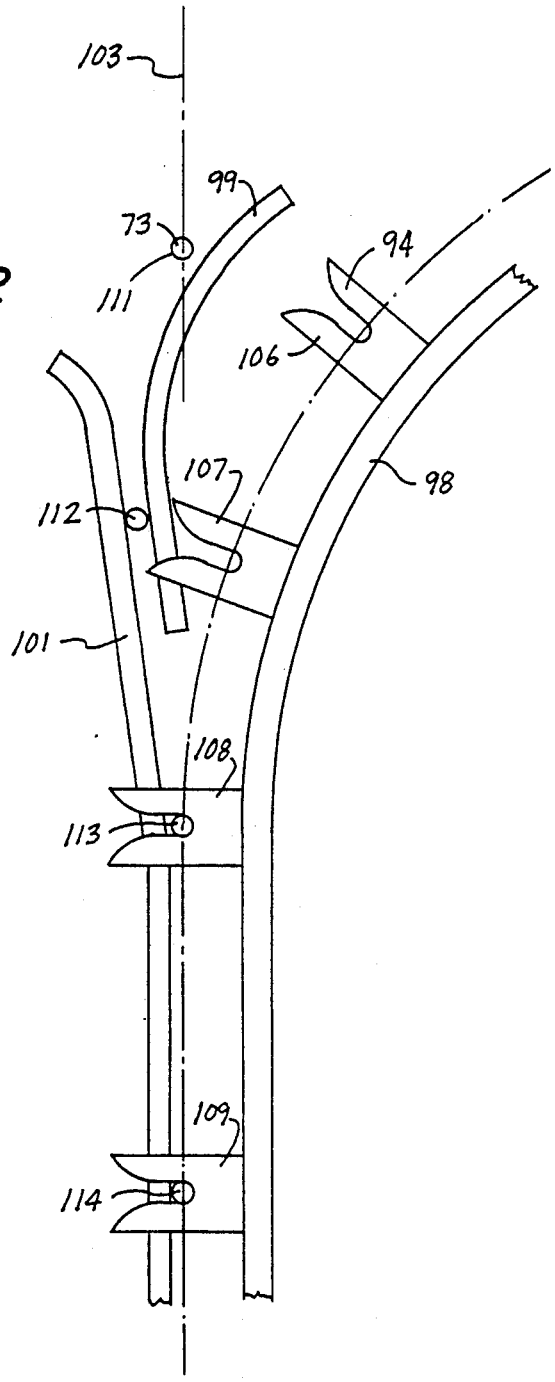

FIG. 22 is a fragmentary plan view illustrating the manner in which the pick-up elements are engaged by the trolleys in the embodiment of FIG. 14.

Figure 23:
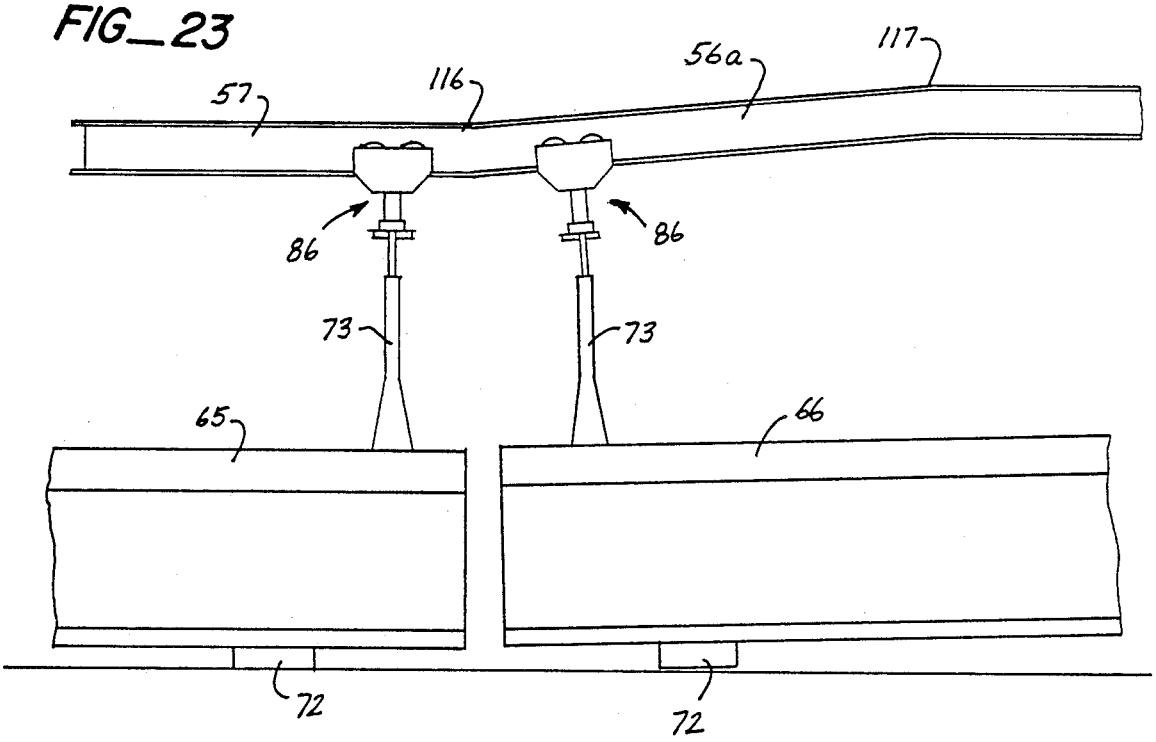
Figure 24:
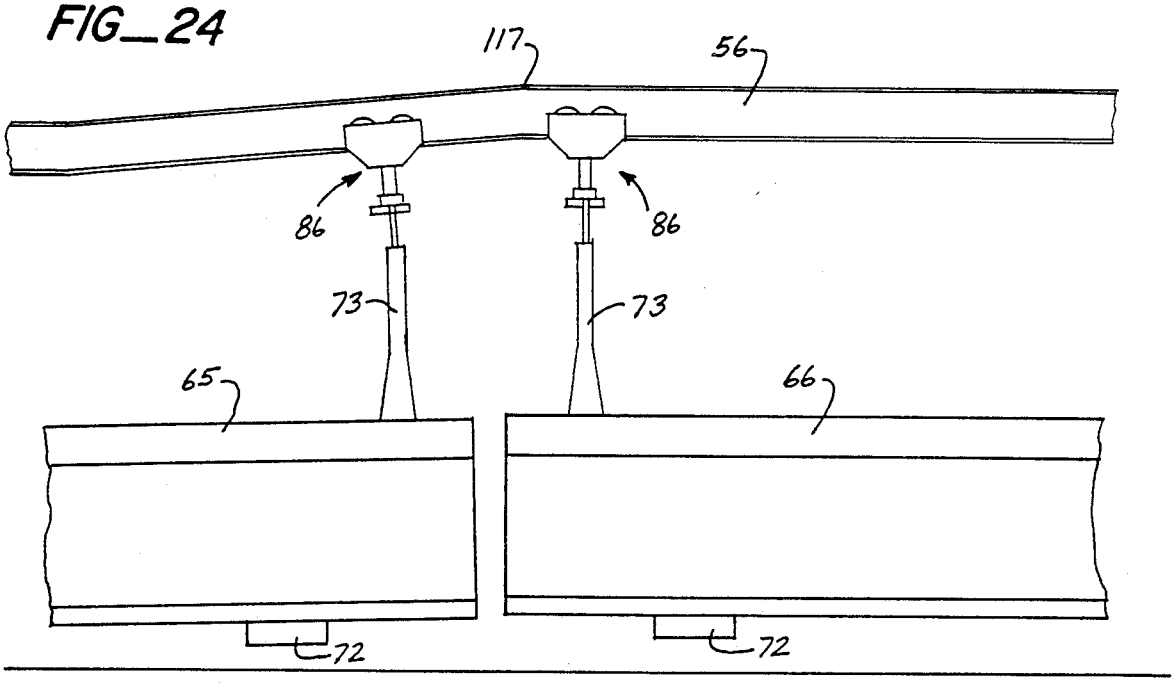

FIGS. 23 and 24 are fragmentary elevational views illustrating the manner in which the barrier sections are lifted and lowered in the embodiment of FIG. 14.

Figure 25:
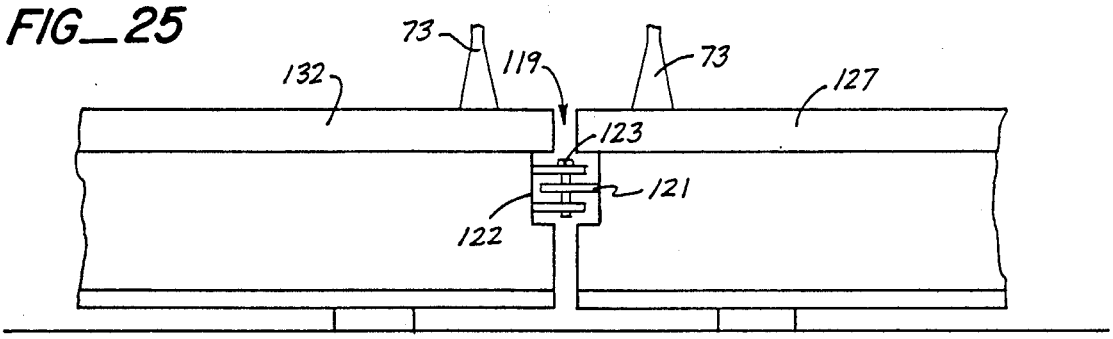

FIG. 25 is a fragmentary elevational view illustrating a hinged connection between two of the barrier sections in the embodiment of FIG. 14

Figure 26:
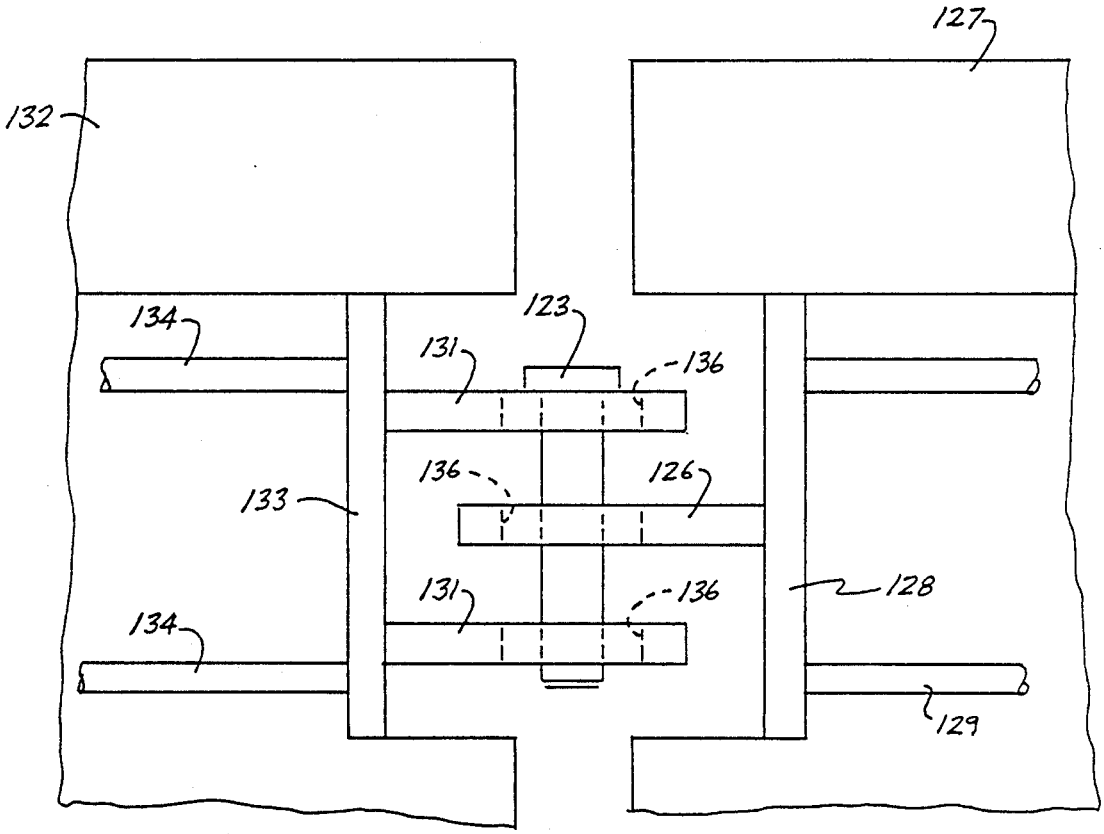

FIG. 26 is an enlarged elevational view of the hinged connection of FIG. 25.

Figure 27:
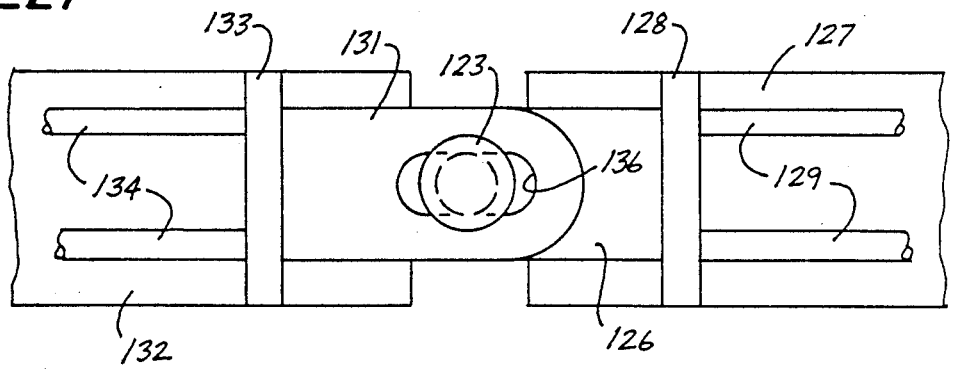

FIG. 27 is an enlarged plan view of the hinged connection of FIG. 25.

Figure 28:
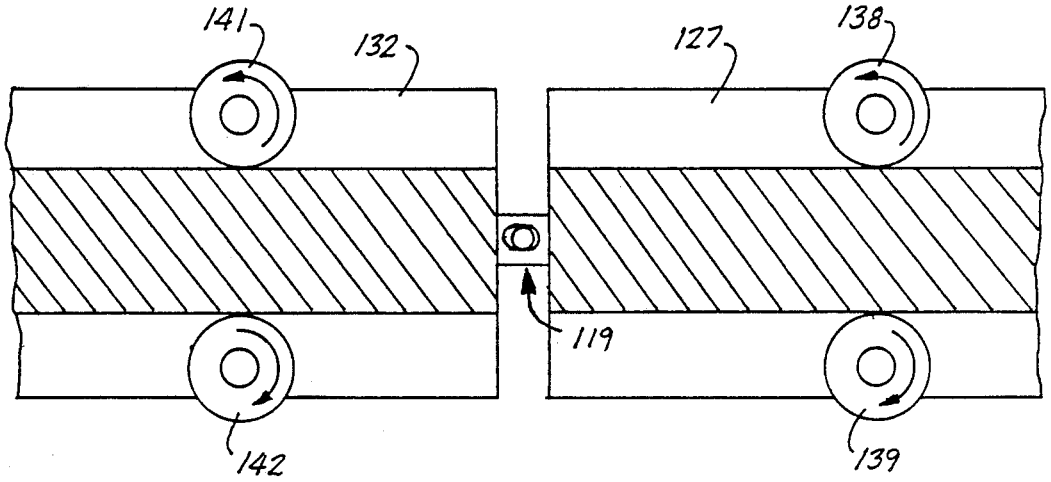

FIG. 28 is a fragmentary horizontal sectional view of the exit portion of the system in the embodiment of FIG. 14.

Figure 1:
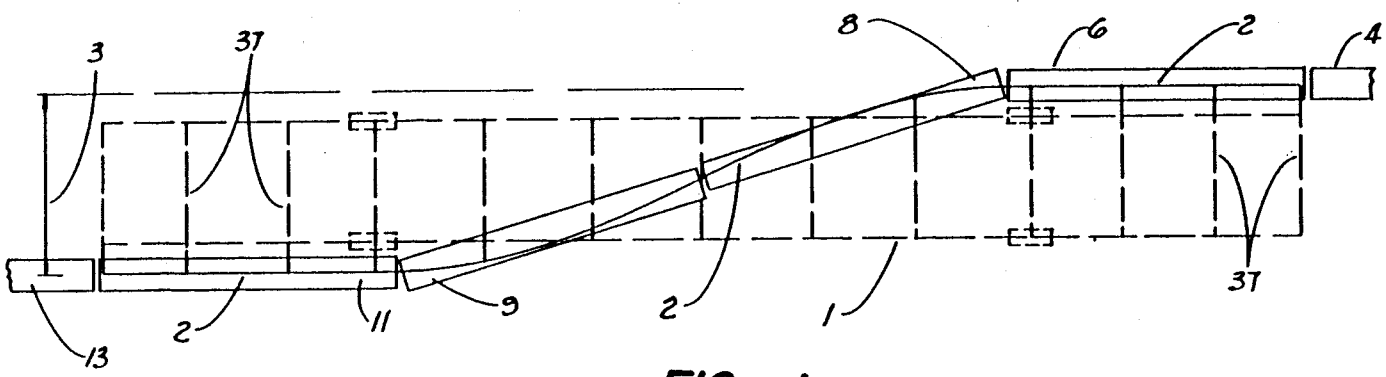
FIG. 1 is a diagrammatic plan showing an embodiment of the transfer system. In this figure, the vehicle is moving to the right of the figure, and the barrier is being from top to bottom of the figure.
Figure 2:
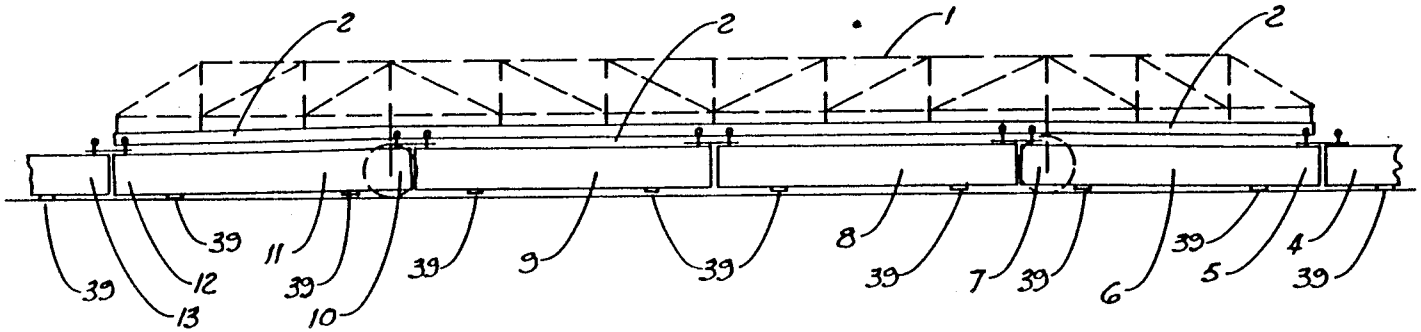
FIG. 2 is a diagrammatic elevation of an embodiment of the invention showing the barrier sections being picked up, transferred, and then set down as the vehicle moves to the right

As previously noted, in FIGS. 1 and 2 the transfer vehicle 1 is moving to the right. The transfer vehicle has four or more wheels, and is, in the preferred embodiment, self-powered, but could be towable. Below the main frame of the vehicle is slung and fixed in place the transfer beam 2. The forward section of this beam is straight, and tangent to a double-curving section, with another straight section at the rear of the vehicle tangent to the double-curved section. The curved section of the beam is maintained parallel to the roadway surface, with the forward straight section sloping upward from forward to rear, and with the rearward straight section sloping downward from forward to rear. The offset 3 between the straight sections of beam is set for the desired width of lane transfer.

In FIGS. 1 and 2, barrier section 4 has not yet been engaged by the transfer beam, the forward end 5 of the barrier section 6 is in the process of being engaged, while the rearward end 7 of barrier section 6 has travelled up the sloping section of beam and has thus been lifted clear of the roadway, but has not yet entered the curving section of the beam. The forward end 10 of barrier section 11 is still suspended, while the rearward end 12 of barrier section 11 has travelled down the sloping section of the beam, and is about to be disengaged from the vehicle. Barrier section 13 has already been set in place.

Figure 4:
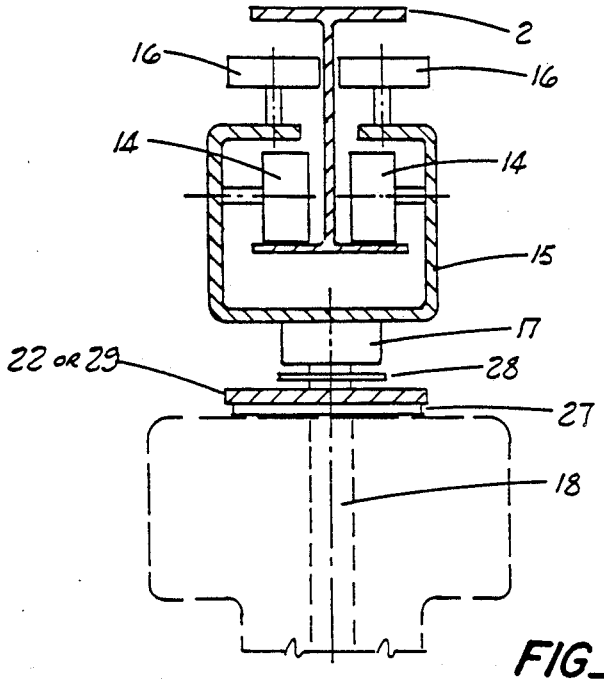
FIG. 4 is a sectional elevation of an embodiment of the assembly by which the barrier units are supported during transfer.

FIGS. 4, 5 and 6 give details of an embodiment of the pick-up mechanism. The transfer beam 2 is either a rolled structural shape, or a shape fabricated from plate, in which the upper surface of the lower flange is horizontal (non-tapered). Rollers 14 which are steel, or steel with tires of urethane or other suitable materials, are supported by the bottom flange of beam 2 and are attached by the yoke plate 15 Guide rollers 16 which are also of steel, or of steel with tires of urethane or other suitable materials, are located on either side of the vertical web of beam 2, and are spaced such that the clear distance between them is slightly greater than the thickness of the web. These rollers 16 are also attached to the yoke plate 15. The boss 17 is rigidly attached to the yoke plate 15 and is attached to the vertical bar 18 in such a manner that it can rotate or swivel about the vertical axis of bar 18, with the angle of rotation either side of center limited to a few degrees greater than the greatest angle subtended between the centerline of the barrier section and the tangent of the curved beam as the barrier moves along the beam. In FIGS. 5 and 6 the transfer beam, which is moving to the right, is bout to engage the suspension and guiding assembly. A guide channel 19 is attached to the top flange of the transfer beam 2 and the splayed vertical legs 20 of this channel serve to guide the rollers 16 into position on either side of the vertical web of beam 2. A short sloping section, 21, of the lower flange of beam 2 serves to ensure that the rollers 14 are properly engaged.

FIGS. 7 and 8 illustrate a preferred embodiment of the spacing and locking mechanism. The shaped steel 22 is free to rotate about the vertical bar 18 of barrier section 23 and is attached to the vertical bar 18 of barrier section 24 through opening 25. In FIG. 7, which illustrates the locked position, the plate 22 has been moved to a position such that the vertical bar 18 barrier section 24 is in the slot of the shaped opening, being held in that position by spring-loaded detente balls or other locking devices. The horizontal wheel 26, which is attached to the transfer vehicle, and is moving to the right, is about to engage plate 22 and move it to the position shown in FIG. 8, in which bar 18 of barrier section 24 has a limited degree of freedom of movement with respect to plate 22. This limited degree of freedom and consequent limited ability for the spacing of the barrier sections to change is necessary to allow for the constantly changing geometry as the barrier units move along the curved transfer beam. The bar 22 is moved to the position shown in FIG. 8 shortly after the unit is engaged by the transfer vehicle. Shortly before the unit is set down after passing through the transfer vehicle, bar 22 is moved back to the position shown in FIG. 7 by another horizontal wheel which engages the opposite side of bar 22 from that engaged by wheel 26, and which, for clarity, is not shown.

Bar 22 is being held clear of the upper surface of the barrier by a washer 27 of fluorocarbon or similar material. Another washer 28, also of fluorocarbon or similar material, is located between plate 22 and boss 17. See FIGS. 4 and 5.

When the barriers are used in locations where the road is curving horizontally, there is a need to change the spacing between the barrier sections to match the difference in arc dimension between the barrier position which has the greater radius and the barrier position which has the lesser radius. FIG. 9 shows an embodiment of the spacing and locking mechanism which allows the barrier sections to be locked at either one of two predetermined spacings or to have a limited degree of freedom. In the position shown, the vertical bar 18 of barrier section 32 has a limited degree of freedom in relation to plate 29. To space and lock the sections for the greater length required by the larger radius of curvature the plate 29 is moved in the upward direction in FIG. 9, forcing bar 18 into slot 30. To space and lock for the smaller radius, bar 18 is forced into slot 31.

Figure 3:
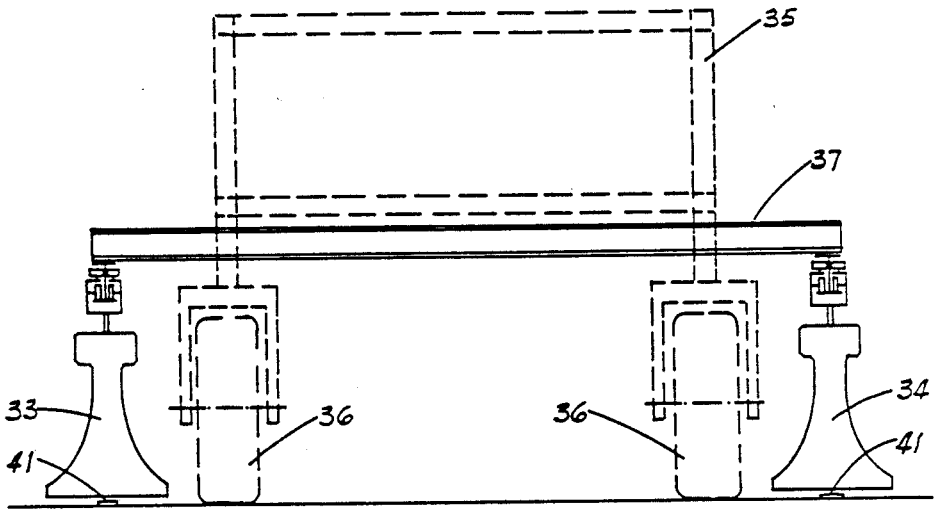
FIG. 3 is a diagrammatic section, looking through the vehicle in the direction of travel, showing the barrier line at left, prior to transfer, and at the right, after transfer.

As is shown diagrammatically in FIG. 1, the transfer vehicle is protected from traffic by the barriers—from oncoming traffic by the barrier which have not yet been transferred; from following traffic by the barriers which have been transferred and placed in their new position. This is further illustrated in FIG. 3, which is a section looking in the direction of travel. The barriers 33 are shown in the location prior to transfer, with the barriers 34 shown in the location after transfer. The main structure 35 and the wheels 36 of the transfer vehicle, which are shown dashed, are clearly within the protected area between the barriers. The transfer beams 37, which directly support the transfer beam, are drawn bold in this figure to clearly illustrate that all parts of the vehicle and mechanism are protected.

The mechanism and system of the present invention can be used to transfer barrier sections of almost any profile, and in lengths up to and beyond that of commonly used barriers which, before the present invention, had to be moved by crane, one section at a time. The barrier sections can be made of steel, reinforced concrete or other commonly available materials. However, in the preferred embodiment, the barriers are of prestressed concrete, using concrete made with heavy aggregates, such as steel slag, which concrete is commonly produced in weights of 300 pounds per cubic foot or more, to increase the mass of the barriers. The preferred profile is similar to that shown in FIG. 10. This profile is similar to those presently being used by many Highway Departments for both fixed and temporary barriers, with the following exceptions and additions.

The flange, 38, has been added at the top of the barrier to increase the mass and strength of the top of the barrier, and also to prevent or inhibit vehicles from climbing or sliding over the barrier. Striations, 40, which are indicated on FIGS. 10 and 11, are cast into the sides of the barrier. These striations can be of many profiles, but the preferred profile is that shown in FIG. 12, which is a horizontal section through the web of the barrier. The purpose of these striations is to aid in bringing a crashing vehicle to a safe stop by promotion mechanical work between the barrier and the vehicle, thus scrubbing off the energy of the crashing vehicle, and, by the dragging force produced, to promote continuous contact between the vehicle and the barrier, thus preventing or inhibiting the vehicle from bouncing off the barrier into the adjacent following traffic.

In the preferred embodiment, the barriers are held clear of the roadway by pads, 39, with two pads for each barrier section, located at approximately twenty percent of the barrier length from each end of the section. These pads, which, in the preferred embodiment are of rubber, but which can be of other materials with a relatively low shear modulus, are bonded to the underside of the barrier sections, as indicated in FIGS. 10 and 11. By holding the barriers clear of the roadway they perform multiple functions. Surface water can drain freely beneath the barrier; lane marker buttons or reflectors, 41, can be used to delineate all lanes without danger of being destroyed during the lane transfer operation; and unevenness in the roadway surface, including the marker buttons or reflectors, presents no problems of rocking or instability.

Most importantly, however, the barrier section is held against lateral movement at only two points and can deflect in bending between and beyond the support points. The pads themselves, being of material with a low shear modulus, can also deflect under load as is illustrated in FIG. 11, which shows the deflected shape of pad 39 due to an impact force acting from right to left. The combination of bending deflection of the barrier between and beyond the support points and the shear deflection of the support pads provides the system with a large energy absorption capacity, and, by decreasing the rate of deceleration of the crashing vehicle, reduces the impact forces. In the preferred embodiment shown in FIGS. 10 and 11 the pads are bonded to the recessed surface 42. The profile of the bottom of the barrier beyond the recess is indicated by line 43.

The principal application of the present invention is to provide a movable barrier between opposing lanes of traffic. For this application, as is illustrated diagrammatically in FIG. 1, as the vehicle moves to the right the barriers are transferred from the top to the bottom of the figure, or from left to right when facing in the direction of travel. To transfer the barriers back to the original position the vehicle direction is reversed, and with the vehicle travelling to the left in the figure the barriers are moved from the bottom to the top of the figure, which is again from left to right when facing in the direction of travel.

There are situations, such as the protection of roadside construction activities, where it may be necessary or desirable to move either from left to right or from right to left when facing in the direction of travel, and this can be accomplished with the embodiment of the invention illustrated diagrammatically in FIG. 13. In this embodiment, to transfer from left to right while facing in the direction of travel beam sections 44 and 45 are joined by the short beam section 46 to form a continuous beam. To reverse the direction of transfer from right to left when facing in the direction of travel beam sections 48 and 49 are joined by the short section 46, which is moved to the position indicated by the dashed line by rotation of the turntable 47. With this embodiment, the direction of transfer can be changed in a matter of minutes.

As previously noted, the vehicle has, in its preferred embodiment, four wheels. These wheels are independently steerable, but the steering mechanism is such that the two front wheels can be steered together and the two rear wheels steered together. It should be noted that this and other references to front and rear are for convenience of reference only, since, as the vehicle is reversible and performs its transfer operation while travelling in either direction, front and rear are also reversible and a function of the particular direction in which the vehicle is proceeding at the time of reference. A driving position from which both the movement and steering of the vehicle can be controlled is located at each end of the vehicle. While the vehicle can be steered form these locations, such manual steering is normally only used when moving the vehicle from its parking area and into the position from which it starts the transfer operation. During the transfer operation, the vehicle is guided by sensors located at each end of the vehicle which can sense the location of the cable buried at a shallow depth below the surface of the roadway, and which, through known types of steering mechanism can guide the vehicle to ensure accurate pickup and placement of the barrier.

The mounting height above the top of the barrier section of the assembly described in FIGS. 4, 5 and 6 is not limited, and thus barriers which have glare screens or other devices projecting above the top of the barrier can be transferred by the system. The assembly described in FIGS. 4, 5 and 6 is such that it can easily be retrofitted to existing barrier sections. These sections can then be spaced and locked, unlocked, transferred, respaced and relocked into place, by the transfer vehicle of the present invention in a similar manner to that of barrier sections of the present invention.

The embodiment illustrated in FIGS. 14-28 is generally similar to the embodiment of FIG. 1 except the transfer beam is in the form of a closed loop, rather than a single s-shaped section, and trolleys which carry the barrier sections are mounted permanently on the beam and move around the loop as the transfer vehicle travels along the lane.

As illustrated in FIGS. 14–16, the transfer vehicle 51 has a truss-like frame 52 and at least four ground engaging wheels 53. As in the embodiment of FIG. 1, the transfer vehicle is preferably self-propelled, but it can be towable, if desired.

A transfer beam 54 is suspended from the frame 52 of the transfer vehicle 51. This beam is in the form of a closed figure-8 loop with an s-shaped section 56 extending diagonally between the two sides of the lane where the barrier sections are placed, a pair of generally semicircular end sections 57, 58 and a straight return section 59 which crosses over the diagonally extending s-shaped section. The beam is an I-beam, with an upper flange 61, a lower flange 62 and a web 63. The end portions **56*a*, 56*b* of the s-shaped section 56** are sloped in a manner similar to the end portions of the beam in the embodiment of FIG. 1, and the central portion 56c of the s-shaped section is flat and generally parallel to the roadway. Return section 59 rises from each end toward the middle to pass over s-shaped section 56 with sufficient clearance that trolleys passing along the return section will pass freely above the s-shaped section.

In FIGS. 14 and 15, the transfer vehicle is assumed to be travelling from left to right, and the barrier sections are being transferred from the upper side of the lane to the lower side in FIG. 14. However, the vehicle can also travel in the other direction, i.e. from right to left, in which case the barrier sections will be transferred from the lower side of the lane to the upper side. In these figures, six barrier sections are shown. Sections 65, 66 are on the left, or upper, side of the lane, sections 67, 68 are being transferred across the lane, and sections 69, 70 are on the right, or lower, side of the lane. Each of the barrier sections has a pair of pads 72 similar to the pads 39 in the embodiment of FIG. 1.

Each of the barrier sections has a pair of upstanding pick-up elements 73 located toward the ends of the section. These elements are utilized in picking up the barrier sections to transfer them from one side of the lane to the other.

As illustrated in FIG. 17, each of the pick-up elements includes a flexible wire rope or cable 74 having a knob 76 with a cylindrical body 77 and an enlarged head 78 affixed to the upper end thereof. The lower end of the cable is affixed to a clevis 81 which is pivotally mounted by a bolt 82 to a plate 83 embedded in the concrete body of the barrier section. As illustrated in FIG. 18, a helically coiled spring 84 encircles the pick-up cable and clevis assembly and holds the cable in an upright or erect rest position while permitting it to be deflected in any horizontal direction.

A plurality of trolleys 86 are mounted on the transfer beam 54 for engagement with the pick-up elements 73 to transfer the barrier sections from one side of the lane to the other. Each of the trolleys has four wheels 87 which ride on the top side of the lower flange 62 of the transfer beam. The wheels are rotatably mounted on cheek plates 88 by axle bolts 89, and an arm 91 is suspended from the cheek plates. The arm is affixed to the cheek plates by bolts 92 which extend between the plates, with spacers 93 between the plates and the arm. A foot plate 94 is affixed to the lower end of the arm and is supported in a generally horizontal position by the arm. The foot plate is generally rectangular in plan view, and it has a tapered notch 96 which opens through the outer end thereof for receiving the knobs 76 at the upper ends of the pick-up cables. The inner portion of the notch is slightly wider than the cylindrical body of the knobs but narrower than the enlarged head. The outer end portion of the foot plate slopes in a downward direction to facilitate engagement with the pick-up elements. An upstanding guide flange 97 is provided at the inner end of the foot plate. The trolleys are connected together by a cable or chain (not shown) for movement as a group around the loop formed by the transfer beam.

Means is provided for guiding the foot plates of the trolleys into and out of engagement with the pick-up elements of the barrier sections. As illustrated in FIG. 22, this means includes a guide channel 98 for the foot plates and an inner guide rail 99 and an outer guide rail 101 for the pick-up cables. Channel 98 is an inverted u-shaped channel in which the guide flanges 97 of the foot plates are received, and it follows the curvature of the transfer beam at the junction between the semicircular end section 57 and the s-shaped section 56. Guide rails 99, 101 are aligned generally with the centerline 103 of the barrier sections on one side of the lane, and they engage opposite sides of the pick-up cables and prevent the cables from deflecting laterally during engagement with and disengagement from the foot plates.

In FIG. 22, the transfer vehicle is assumed to be travelling in an upward direction, and the guides shown in this Figure are located at the forward end of the vehicle. Similar guides are provided at the other end of the vehicle. As the vehicle travels in the forward direction, the foot plate 94 moves successively through positions 106 to 109 as it moves along the transfer beam, with the inner end of notch 96 being brought into alignment with the centerline 103 of the barrier sections ahead of the vehicle. At the same time, pickup element 73 successively occupies positions 111 to 114 relative to the vehicle and guide rails. As the foot plate and pick-up element approach positions 108 and 113, they come into engagement, with the knob of the pick-up element being received in the notch of the foot plate.

If the vehicle were travelling in the other direction, the foot plate would move successively from position 109 to position 106, and the pick-up element would move from position 114 to position 111, with the foot plate becoming disengaged or separated from the pick-up element.

The manner in which the barrier sections are picked up by the trolleys is illustrated in FIGS. 23 and 24. In these figures, the vehicle is assumed to be travelling from right to left. The beam slopes in an upward direction from the junction 116 between the semicircular end section 57 and the s-shaped diagonally extending section 56 to a point 117 near the start of the diagonal run of the section.

In FIG. 23, one of the trolleys 86 has engaged the pick-up cable 73 on the trailing end of barrier section 66 and is starting to move up the inclined section of the transfer beam as the vehicle travels toward the left, thereby lifting that end of the barrier section off the ground. The next trolley 86 is moving into engagement with the pick-up cable 73 at the leading end of the next barrier section 65, but has not as yet started up the inclined section of the beam. Consequently, section 65 is still on the ground.

In FIG. 24, the trolley which has picked up the trailing end of barrier section 66 has reached the level section of the beam, and the trolley which has picked up the leading end of barrier section 65 is approaching the level section. Section 66 is thus fully suspended in a level position and is moving across the lane, and section 65 is being carried up the inclined section of the beam.

The manner in which the barrier sections are set back down on the roadway is the reverse of the manner in which they are picked up. The trolleys move from the level portion of the diagonally extending section of the transfer beam down an inclined portion to the level section at the trailing end of the vehicle, thereby setting the barrier sections down on the ground. Since inclined sections are provided at both ends of the vehicle, the vehicle can travel in either direction, with the barrier sections being picked up at the leading end and set down at the trailing end.

As illustrated in FIGS. 25–27, the sections of the barrier are connected together by hinges 119 which permit the sections to be placed at different angles to each other and to be spaced different distances apart.

Each of the hinges includes a section 121 at the leading end of one barrier section, a section 122 at the trailing end of the next, and a pin 123 joining the two hinge sections together. Section 121 includes a horizontal plate 126 which projects longitudinally to the front of barrier section 127. Plate 126 is affixed to a base plate 128 which is affixed to reinforcing bars 129 embedded in the concrete body of the barrier section. Hinge section 122 includes a pair of horizontally spaced apart plates 131 which project longitudinally to the rear from barrier section 132 above and below plate 126 of hinge section 121. Plates 131 are affixed to a base plate 133 which is affixed to reinforcing bars 134 embedded in the body of the barrier section. Vertically aligned openings 136 are formed in the hinge plates for receiving the hinge pin 123. These openings are elongated in the longitudinal direction to permit the barrier sections to be set different distances apart.

Means is provided for controlling the spacing between the barrier sections as they are set down on the roadway. This means includes two pairs of drive rollers 138, 139 and 141, 142 which are carried by the transfer vehicle for engagement with the sides of the respective barrier sections. The rollers on opposite sides of the barrier sections are driven in opposite directions, and the relative speeds of the two pairs of rollers is adjustable to control the spacing between the barrier sections. In this figure, it is assumed that the transfer vehicle is travelling toward the left and that barrier section 137 has already been set down on the pavement. By increasing the speed of rollers 141, 142 relative to rollers 138, 139, the spacing between the two barrier sections can be reduced, and by decreasing the speed of rollers 141, 142, the spacing can be increased.

The side walls or webs of the barrier sections in the embodiment of FIGS. 14-28 are formed with striations similar to the striations 40 in the embodiment of FIG. 1. These striations extend downwardly and forwardly relative to the direction of traffic flow in the lanes adjacent thereto and help to dissipate the energy of a vehicle contacting the barrier as well as helping to prevent the vehicle from climbing over the barrier.

It is apparent from the foregoing that a new and improved roadway barrier system has been provided. While only certain presently preferred embodiments have been described in detail, as will be apparent to those familiar with the art, certain changes and modifications can be made without departing from the scope of the invention as defined by the following claims.

I claim:

1. A roadway barrier system which provides a safe separation between opposing lanes of vehicular traffic and is capable of being moved across a lane to change the direction of traffic flow in the lane, comprising: a plurality of elongated barrier sections positioned end-to-end along one side of the lane, a vehicle which travels along the lane having a transfer beam in the form of a closed loop with a portion of the beam extending diagonally across the lane, and a plurality of trolleys mounted on the transfer beam for movement around the loop and into lifting engagement with successive ones of the barrier sections for carrying the barrier sections across the diagonally extending portion of the beam from one side of the lane to the other as the vehicle travels along the lane.

2. The barrier system of claim 1 wherein the transfer beam is in the form of a figure-8, with a portion of the beam spaced above the diagonally extending portion.

3. The barrier system of claim 1 including pick-up elements attached to the barrier sections near the ends thereof, and means carried by the trolleys for engagement with the pick-up elements.

4. The barrier system of claim 3 wherein the pick-up elements include flexible cables, and coil springs encircling the cables and urging the cables toward an upright position.

5. The barrier system of claim 1 including hinge means connecting successive ones of the barrier sections together.

6. The barrier system of claim 5 wherein the hinge means includes horizontally extending plates affixed to the barrier sections and projecting from the end portions thereof, and a pin passing through vertically aligned openings in the flanges.

7. The barrier system of claim 6 wherein the hinge plates on adjacent ends of the barrier sections are spaced apart vertically, and the openings in the plates are larger than the pins to permit the successive barrier sections to be positioned at different angles relative to each other and different distances apart.

8. The barrier system of claim 7 wherein the openings in the hinge plates are elongated in the longitudinal direction.

9. The barrier system of claim 1 including a drive wheel carried by the vehicle and engageable with the barrier sections as they exit from the diagonally extending portion of the transfer beam for adjusting the longitudinal spacing between the sections.

10. The barrier system of claim 1 wherein the barrier sections have side walls facing the traffic lanes with striations in said walls extending downwardly and forwardly relative to the direction of traffic flow in the lanes adjacent thereto.

11. A roadway barrier system which provides a safe separation between opposing lanes of vehicular traffic and is capable of being moved across a lane to change the direction of traffic flow in the lane, comprising: a plurality of elongated barrier sections positioned end-to-end along one side of the lane, hinge means connecting successive ones of the barrier sections together, a vehicle which travels along the lane having a transfer beam in the form of a figure-8 with a portion of the beam extending diagonally across the lane, a pair of upstanding pick-up cables affixed to each of the barrier sections, and a plurality of trolleys mounted on the transfer beam for movement around the loop and into engagement with the pick-up cables on successive ones of the barrier sections for carrying the barrier sections across the diagonally extending portion of the beam from one side of the lane to the other as the vehicle travels along the lane.

12. The barrier system of claim 11 wherein the hinge means includes horizontally extending plates affixed to the barrier sections and projecting from the end portions thereof, and a pin passing through vertically aligned openings in the flanges.

13. The barrier system of claim 12 wherein the hinge plates on adjacent ends of the barrier sections are spaced apart vertically, and the openings in the plates are larger than the pins to permit the successive barrier sections to be positioned at different angles relative to each other and different distances apart.

14. The barrier system of claim 13 wherein the openings in the hinge plates are elongated in the longitudinal direction.

15. The barrier system of claim 11 including a drive wheel carried by the vehicle and engageable the barrier sections as they exit from the diagonally extending portion of the transfer beam for adjusting the longitudinal spacing between the sections.

16. The barrier system of claim 11 wherein the barrier sections have side walls facing the traffic lanes with striations in said walls extending downwardly and forwardly relative to the direction of traffic flow in the lanes adjacent thereto.

* * * * *